US006279533B1

(12) United States Patent
Beil

(10) Patent No.: US 6,279,533 B1
(45) Date of Patent: Aug. 28, 2001

(54) LOAD ADJUSTMENT DEVICE

(75) Inventor: Egon Beil, Florstadt (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/381,565

(22) PCT Filed: Feb. 7, 1998

(86) PCT No.: PCT/EP98/00675

§ 371 Date: Dec. 2, 1999

§ 102(e) Date: Dec. 2, 1999

(87) PCT Pub. No.: WO98/41745

PCT Pub. Date: Sep. 24, 1998

(30) Foreign Application Priority Data

Mar. 19, 1997 (DE) ..... 197 11 408

(51) Int. Cl.[7] ..... F02D 9/02
(52) U.S. Cl. ..... 123/396; 123/399
(58) Field of Search ..... 123/361, 396, 123/399, 400

(56) References Cited

U.S. PATENT DOCUMENTS

| | | | |
|---|---|---|---|
| 4,989,566 | 2/1991 | Wallerand | 123/339.16 |
| 5,133,320 | 7/1992 | Kato et al. | 123/397 |
| 5,718,201 * | 2/1998 | Hannewald | 123/396 |
| 5,775,292 * | 7/1998 | Seeger | 123/396 |
| 5,820,178 * | 10/1998 | Ellis et al. | 292/336.3 |

FOREIGN PATENT DOCUMENTS

| | | |
|---|---|---|
| 2728022 | 1/1979 | (DE) . |
| 4013823 | 10/1991 | (DE) . |
| 4132653 | 4/1993 | (DE) . |
| 4315010 | 11/1994 | (DE) . |

* cited by examiner

*Primary Examiner*—Tony M. Argenbright
(74) *Attorney, Agent, or Firm*—Martin A. Farber

(57) ABSTRACT

A load adjustment apparatus for an internal combustion engine has a torsion spring (4) which is attached in a positively locking manner to a control shaft (3) for a throttle valve and a supporting part (2). At one end, the torsion spring (4) is bent in a U-shape in order to engage around a pin (17) of the supporting part (2), and has a spring tongue (16) which points in the direction of the base of the U. For mounting, the open end of the U of the torsion spring (4) is pressed over the pin (17) until the spring tongue (16) snaps in behind the pin (17). The torsion spring (4) is then connected in a positively locking manner to the pin (17) and can transmit forces in both rotation directions to the control shaft (3).

18 Claims, 3 Drawing Sheets

LOAD ADJUSTMENT DEVICE

FIELD AND BACKGROUND OF THE INVENTION

The invention relates to a load adjustment apparatus having an actuating element which controls the power of an internal combustion engine, is designed in particular as a throttle valve and is arranged on a control shaft, in which case the control shaft can be driven by means of a reversible actuating drive such that it can pivot between a minimum load position and a full load position, and having a single torsion spring, which is designed as a return spring to prestress the control shaft in the minimum load direction and as an emergency running spring to prestress the control shaft against an emergency running stop, the first end of which torsion spring is connected or can be connected to the control shaft while its second end is connected or can be connected to an arm of a supporting part which can move between a minimum load stop and the emergency running stop.

Load adjustment apparatuses of the type mentioned above are known in general by the name E-Gas, for adjusting the power of internal combustion engines in motor vehicles. By using a single torsion spring as an emergency running spring and as a return spring, the load adjustment apparatus has a particularly compact design, and is particularly light in weight.

A disadvantage of the known load adjustment apparatus is that the ends of the torsion spring must be attached in a complex manner to the control shaft and to the supporting part, since the torsion spring exerts actuating forces which act in both rotation directions of the control shaft. Furthermore, vibration in the motor vehicle can lead to the attachment of the torsion spring becoming loose. As a rule, the control shaft has a slot, into which the torsion spring is inserted, in order to attach the torsion spring to the control shaft.

It would be feasible to screw the second end of the torsion spring firmly to the supporting part. However, a load adjustment apparatus designed in such a way would be particularly costly. Furthermore, vibration can cause a screw to become loose, so that the torsion spring would then no longer be connected to the supporting part.

SUMMARY OF THE INVENTION

The invention is based on the objective of providing a load adjustment apparatus of the type mentioned initially such that it can be constructed particularly cost-effectively, and such that the torsion spring is attached to the supporting part in a particularly reliable manner.

This problem is solved according to the invention in that the second end of the torsion spring is provided to engage behind an element of the supporting part.

By this, the torsion spring can transmit actuating forces which act in both directions of the control shaft to the supporting part, without being able to become detached from the supporting part on its own. Vibration in the motor vehicle likewise no longer leads to the torsion spring becoming detached from the supporting part. In consequence, the torsion spring is attached to the supporting part in a positively locking manner, and thus particularly reliably. The fact that the torsion spring engages behind an element of the supporting part results in a design which is particularly cost-effective in comparison to a screwed joint.

According to an advantageous development of the invention, the way in which the attachment of the torsion spring to the supporting part is designed is physically particularly simple if the second end of the torsion spring is designed such that it surrounds a pin of the supporting part. In consequence, the second end of the torsion spring just needs to be plugged onto the pin of the supporting part for mounting.

According to another advantageous development of the invention, the second end of the torsion spring is held particularly reliably on the supporting part if the second end of the torsion spring is bent in a U-shape and, at its free end, has a spring tongue which points in the direction of the base of the U.

Another advantageous development of the invention contributes to further reducing the costs for the attachment of the torsion spring by the spring tongue being bent away from the torsion spring.

According to another advantageous development of the invention, an easy way to avoid the second end of the torsion spring becoming detached from the pin of the supporting part in the direction of the axis of the pin is for the pin of the supporting part to be designed such that it engages around the second end of the torsion spring.

According to another advantageous development of the invention, the second end of the torsion spring is secured against becoming detached in any direction if the pin of the supporting part has a recess for holding the second end of the torsion spring.

According to another advantageous development of the invention, the torsion spring can easily be secured against tilting if the supporting part has a baseplate for guiding the torsion spring.

According to another advantageous development of the invention, the torsion spring can be prevented from being jammed at one edge of the supporting part if, in its radially outer regions, the supporting part has a plurality of stops for limiting the radial extension of the torsion spring.

According to another advantageous development of the invention, the torsion spring is held reliably on the supporting part even in the event of severe vibration, if the stops are designed such that they engage around the torsion spring.

According to another advantageous development of the invention, the supporting part can be manufactured particularly cost-effectively if the supporting part is manufactured integrally with the stops and the pin.

BRIEF DESCRIPTION OF THE DRAWINGS

The invention allows numerous embodiments. In order to explain the basic principle of the invention further, two of these embodiments are described in the following text and are illustrated in the drawings, in which.

DETAILED DESCRIPTION OF THE PREFERRED EMBODIMENTS

Figure 1:
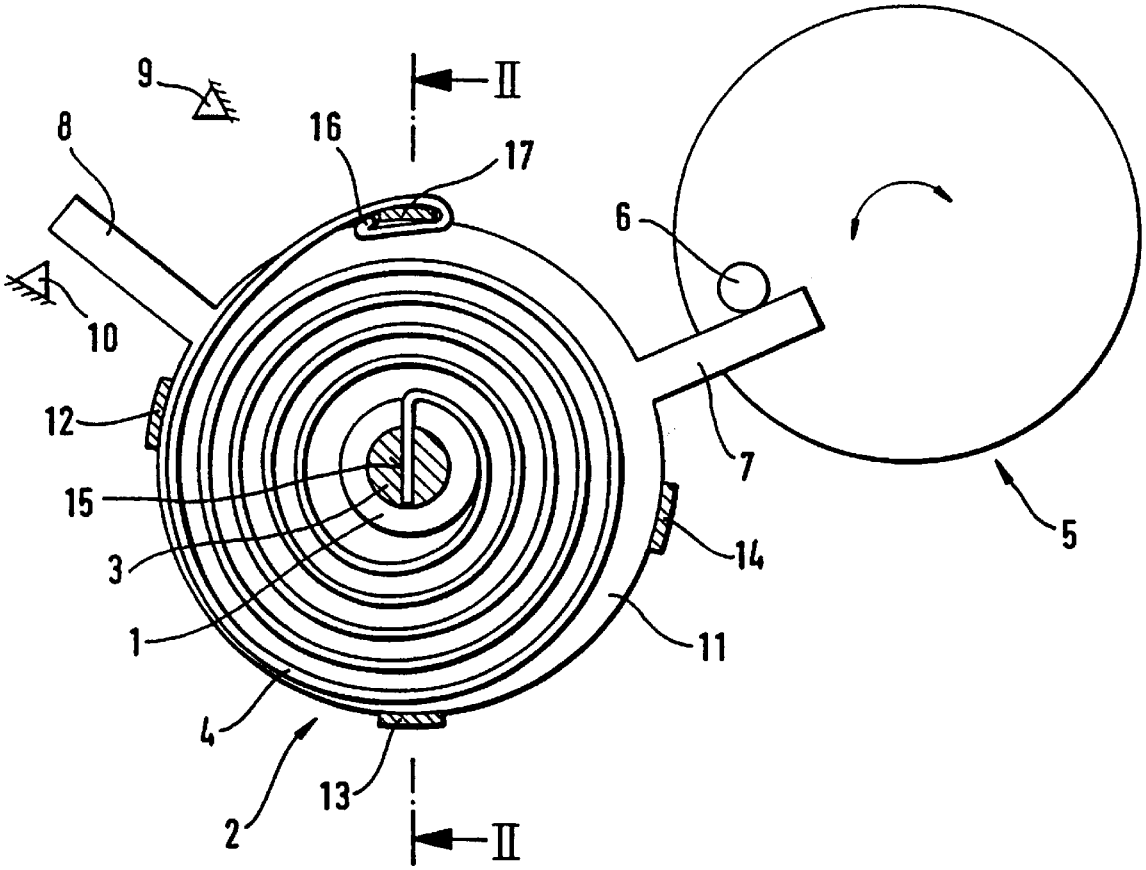
FIG. 1 shows a view from above of a load adjustment apparatus according to the invention.

FIG. 1 shows a load adjustment apparatus according to the invention, having a supporting part 2 which is mounted on a housing stub 1 such that it can pivot. A control shaft 3 which may be, for example, a throttle valve shaft having a throttle valve (which is not illustrated) is mounted in the center of the housing stub 1, likewise such that it can pivot. The control shaft 3 (which, for example, is welded to the supporting part 2 or forms a physical unit) is connected via a torsion spring 4 to the supporting part 2 and can be pivoted by a reversible actuating drive 5 via a gearbox which, in order to simplify the drawing, is not illustrated. Furthermore, the actuating drive 5 has a driver 6 for deflecting a pivoting arm 7 of the supporting part 2. The supporting part 2 has a stop arm 8, which limits the movement of the supporting part 2 between a minimum load stop 9 and an emergency running stop 10. The supporting part 2 has a baseplate 11 for guiding the torsion spring 4 and, in its radially outer regions, a plurality of stops 12 to 14 in order to limit the radial extension of the torsion spring 4.

For attachment of the torsion spring 4, the control shaft 3 has a slot 15, into which one end of the torsion spring 4 is inserted. The second end of the torsion spring 4 is bent in a U-shape and has a spring tongue 16, which points in the direction of the base of the U, in order to engage behind a pin 17 of the supporting part 2. For mounting the second end of the torsion spring 4 on the supporting part 2, the open end of the U is pressed over the pin 17 until the spring tongue 16 snaps in behind the pin 17. In consequence, the torsion spring 4 can transmit forces in both rotation directions to the control shaft 3.

Figure 2:
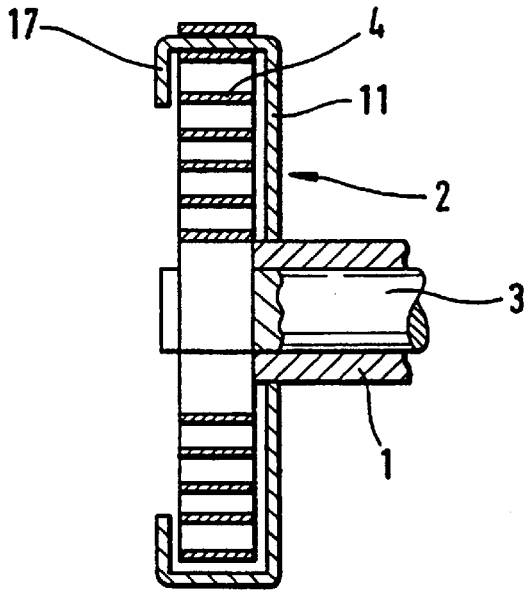
FIG. 2 shows a section illustration through the load adjustment apparatus from FIG. 1.

FIG. 2 uses a section illustration along the line II—II in FIG. 1 to show that the stops 12 to 14 and the pin 17 are bent radially inward at their end facing away from the baseplate 11 for the torsion spring 4. In consequence, the torsion spring 4 is held on the baseplate 11 and is prevented from falling out of the slot 15 in the control shaft 3.

Figure 3:
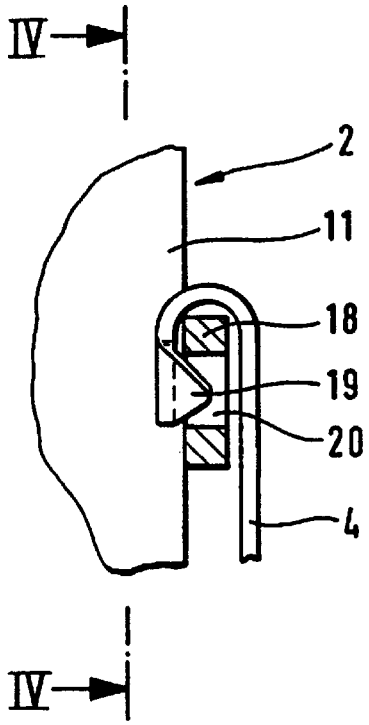
FIG. 3 shows an enlarged illustration of an attachment of a torsion spring to a supporting part.

FIG. 3 shows a further embodiment of the attachment of the torsion spring 4 to the supporting part 2. The supporting part 2 has a pin 18, which is arranged at right-angles to the baseplate 11. One end of a torsion spring 4, which is bent in a U-shape, engages around the pin 18. The end of the torsion spring 4 has a bend 19 in order to engage in a recess 20 in the pin 18.

Figure 4:
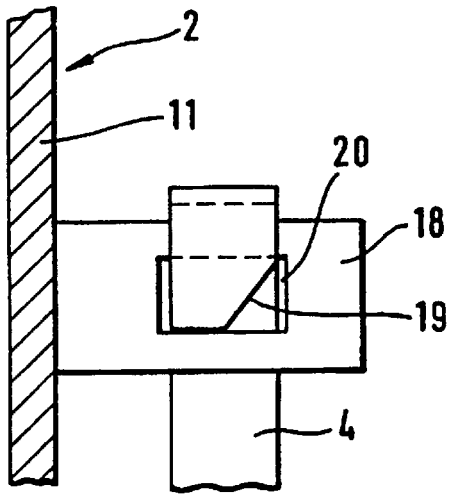
FIG. 4 shows a section illustration through the torsion spring and the supporting part from FIG. 3, along the line IV—IV.

FIG. 4 uses a section illustration along the line IV—IV in FIG. 3 to illustrate the attachment of the torsion spring 4 to the pin 18. This shows that the bend 19 is formed by one corner of the free end of the torsion spring 4.

Figure 5:
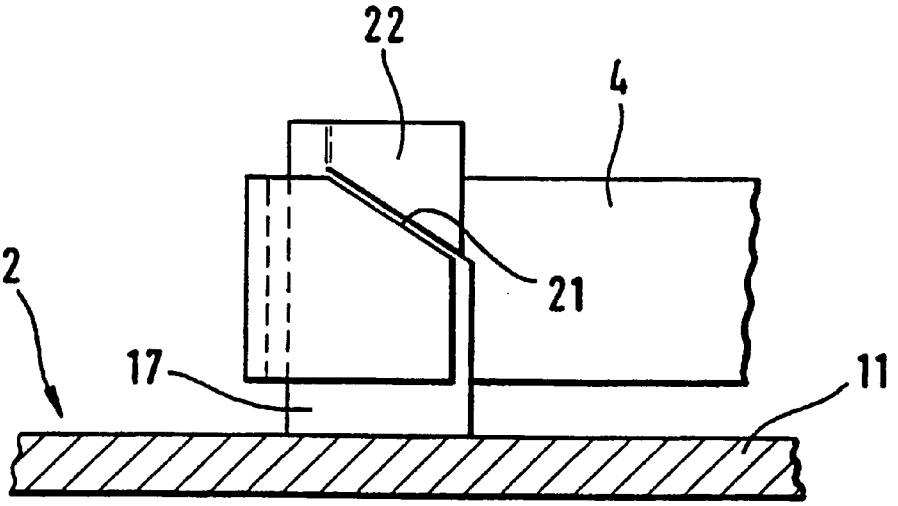
FIG. 5 shows a further enlarged illustration of an attachment of a torsion spring to a supporting part.

It can be seen in FIG. 5 that the pin 17 of the supporting part 2 is designed such that it engages around the second end of the torsion spring 4. For this purpose, the torsion spring 4 has an incline 21 at its second end in the longitudinal direction. The pin 17 has a bend 22 which is formed, for example by stamping, from the originally straight pin 17. The incline 21 on the torsion spring 4 and the incline on the bend 22 run parallel, with the bend 22 engaging over the incline 21 of the torsion spring, so that, after being inserted, the torsion spring 4 is fixed in position, loaded by the interaction of the incline 21 and bend 22 which engages over it.

Figure 6:
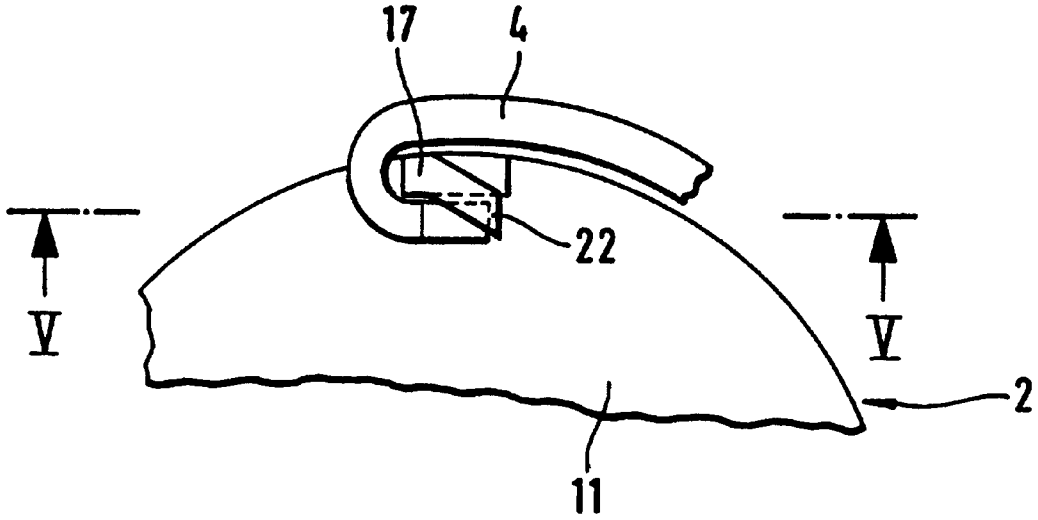
FIG. 6 shows a section illustration through the torsion spring and the supporting part from FIG. 5, along the line V—V.

FIG. 6 uses a section illustration along the line V—V in FIG. 5 to show the attachment of the torsion spring 4 to the pin 17. It can be seen in this case that the bend 22 engages over the second end of the torsion spring 4. The installation process is carried out, for example, in such a manner that the torsion spring is held prestressed by an installation tool and the U-shaped second end (when looking at FIG. 6 from the left) is moved to be at a distance from the pin 17, and is then moved to the side so that the incline 21 passes under the bend 22. Once the installation tool is removed (if appropriate, once the first end of the torsion spring has also been fixed in position), the torsion spring 4 is subject to its nominal load and, in consequence, pulls the incline 21 further under the bend 22 until the fixing position is reached.

LIST OF REFERENCE SYMBOLS

1. Housing stub
2. Supporting part
3. Control shaft
4. Torsion spring
5. Actuating drive
6. Driver
7. Pivoting arm
8. Stop arm
9. Minimum load stop
10. Emergency running stop
11. Baseplate
12. Stop
13. Stop
14. Stop
15. Slot
16. Spring tongue
17. Pin
18. Pin
19. Bend
20. Recess
21. Incline
22. Bend

What is claimed is:

1. A load adjustment apparatus having an actuating element which controls power of an internal combustion engine, is designed in particular as a throttle valve and is arranged on a control shaft, wherein the control shaft is driven by a reversible actuating drive which is pivotal between a minimum load position and a full load position, a single torsion spring constituted as a return spring prestressing the control shaft in the minimum load direction and as an emergency running spring prestressing the control shaft against an emergency running stop, a first end of said torsion spring being connectable to the control shaft and a second end of said torsion spring being connectable to an arm of a supporting part which arm is movable between a minimum load stop and the emergency running stop, wherein the second end of the torsion spring engages around a pin of the supporting part, wherein the second end of the torsion spring has an incline with respect to a longitudinal direction of the second end of the torsion spring, and the pin has an engaging bend.

2. The load adjustment apparatus as claimed in claim 1, wherein the second end of the torsion spring surrounds said pin of the supporting part.

3. The load adjustment apparatus as claimed in claim 1, wherein the second end of the torsion spring is bent in a U-shape, with a base and a free end opposite the base and, at the free end of the torsion spring, has a spring tongue which points in the direction of the base of the U.

4. The load adjustment apparatus as claimed in claim 3, wherein the spring tongue is bent away from the torsion spring.

5. The load adjustment apparatus as claimed in claim 1, wherein the pin of the supporting part has a recess for holding the second end of the torsion spring.

6. The load adjustment apparatus as claimed in claim 1, wherein the supporting part has a baseplate for guiding the torsion spring.

7. The load adjustment apparatus as claimed in claim 1, wherein, in radially outer regions of the apparatus, the supporting part has a plurality of stops for limiting the radial extension of the torsion spring.

8. The load adjustment apparatus as claimed in claim 7, wherein the stops engage around the torsion spring.

9. The load adjustment apparatus as claimed in claim 7, wherein the supporting part is integral with the stops and the pin.

10. The load adjustment apparatus as claimed in claim 1, wherein the bend of the pin has an incline with respect to said longitudinal direction, said incline of said bend engages thereunder said incline of said spring, said inclines being inclined with respect to an axis of said pin, thereby securing engagement of the torsion spring against vibrations in the longitudinal direction and axial direction.

11. The load adjustment apparatus as claimed in claim 10, wherein the second end of the torsion spring surrounds said pin of the supporting part.

12. The load adjustment apparatus as claimed in claim 10, wherein the supporting part has a baseplate for guiding the torsion spring.

13. The load adjustment apparatus as claimed in claim 11, wherein, in radially outer regions of the apparatus, the supporting part has a plurality of stops for limiting the radial extension of the torsion spring.

14. The load adjustment apparatus as claimed in claim 13, wherein the stops engage around the torsion spring.

15. The load adjustment apparatus as claimed in claim 13, wherein the supporting part is integral with the stops and the pin.

16. The load adjustment apparatus as claimed in claim 10, wherein the bend is a stamped part of the pin.

17. The load adjustment apparatus as claimed in claim 10, wherein said inclines are planar surfaces.

18. The load adjustment apparatus as claimed in claim 10, wherein said inclines are parallel to each other.

* * * * *